US006290629B1

(12) United States Patent
Vargas, III et al.

(10) Patent No.: US 6,290,629 B1
(45) Date of Patent: Sep. 18, 2001

(54) UNDERWATER EXERCISE APPARATUS

(76) Inventors: Joseph H. Vargas, III, R.R. #3, Box 7118, Rutland, VT (US) 05701; Galen M. Williams, P.O. Box 472, North Springfield, VT (US) 05150

( * ) Notice: Subject to any disclaimer, the term of this patent is extended or adjusted under 35 U.S.C. 154(b) by 0 days.

(21) Appl. No.: 09/370,276

(22) Filed: Aug. 9, 1999

(51) Int. Cl.[7] ..... A63B 22/06
(52) U.S. Cl. ..... 482/57; 482/58; 482/63
(58) Field of Search ..... 482/51, 52, 53, 482/57, 58, 59, 62, 63, 70, 72, 79, 80, 111, 146

(56) References Cited

U.S. PATENT DOCUMENTS

| | | | | |
|---|---|---|---|---|
| 4,162,788 | | 7/1979 | Turnier . | |
| 4,537,396 | * | 8/1985 | Hooper | 272/130 |
| 4,971,317 | * | 11/1990 | Link | 272/73 |
| 5,123,641 | | 6/1992 | Abboudi et al. . | |
| 5,246,410 | * | 9/1993 | Fun | 482/53 |
| 5,316,532 | | 5/1994 | Butler . | |
| 5,342,262 | * | 8/1994 | Hansen | 482/62 |
| 5,354,253 | | 10/1994 | Awbrey et al. . | |
| 5,407,406 | * | 4/1995 | Canela | 482/51 |
| 5,487,713 | | 1/1996 | Butler . | |
| 5,586,961 | | 12/1996 | Quint . | |
| 5,647,826 | | 7/1997 | Butler . | |
| 5,665,039 | | 9/1997 | Wasserman et al. . | |
| 5,865,711 | * | 2/1999 | Chen | 482/57 |

* cited by examiner

*Primary Examiner*—Mickey Yu
*Assistant Examiner*—Tam Nguyen
(74) *Attorney, Agent, or Firm*—John J. Welch, Jr., Esq.

(57) ABSTRACT

An underwater exercise apparatus consisting of a pair of fastening vices amenable to being held together by screws and bolts and serving to removably hold an elongated support arm to which a seat for sitting is attached and further serving to hold together a pair of oppositely positioned three-sided support units each of which rests upon a pair of adjustable foot pods and atop each elongated middle side of each of which support units there is affixed a housing unit containing a wheel and pedal mechanism in turn connected to a pair of pedals; each connected to one end of an elastic cord with each cord being affixed at a second end of each to a support block, one support block being affixed atop a posterior side of one support unit and one support block being affixed atop a posterior side of the other support unit and with there being affixed atop an anterior side of each support unit, an adjustable upright handlebar.

1 Claim, 11 Drawing Sheets

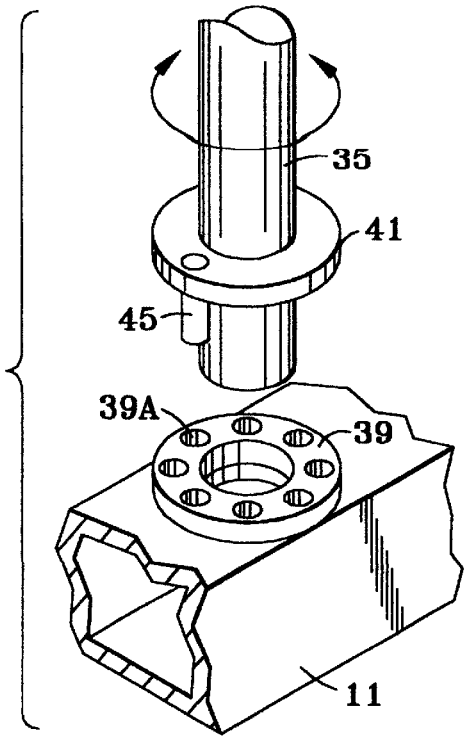
FIG. 7
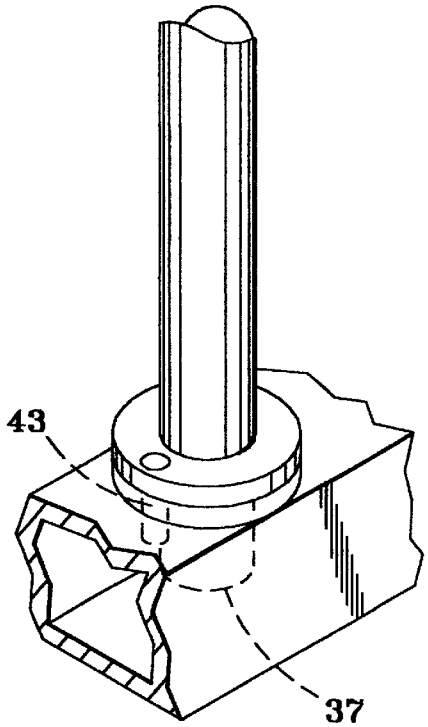
FIG. 8
FIG. 9
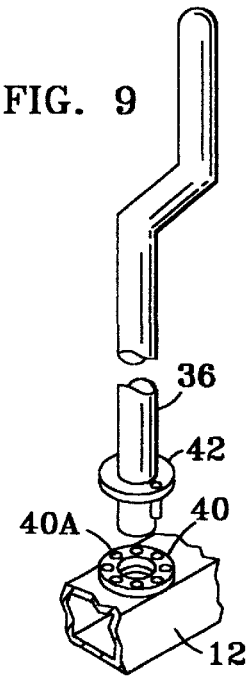
FIG. 10
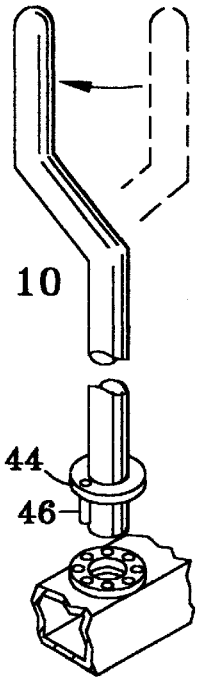
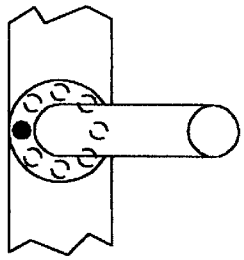
FIG. 11
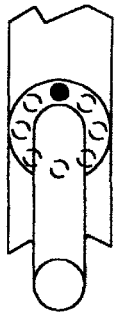
FIG. 12

UNDERWATER EXERCISE APPARATUS

CROSS REFERENCES TO PRIOR OR PARENT APPLICATIONS

There are no prior or parent applications.

FEDERALLY SPONSORED RESEARCH AND DEVELOPMENT

Not Applicable.

BACKGROUND OF THE INVENTION

1. Field of the Invention

The instant invention relates to devices that facilitate mechanical exercising of the muscles of the body.

2. Informational Statement

Related art that however does not anticipate the instant invention is referred to in the Informational Statement filed herewith.

A SUMMARY OF THE INVENTION

1. A Brief Description of the Invention:

The instant invention consists of a pair of oppositely positioned three-sided support units in contact with one another along an elongated middle side of each. Each support unit rests adjustably upon a pair of footing pods. Each support unit is joined to the other along the middle side of each by fastening vices in turn screwed and bolted together. Removably affixable to and within the fastening vices is an elongated support arm to which there is affixed a seat upon which a person may sit. Atop and affixed to the two elongated middle sides of the support units is a housing unit within which a wheel and pedal mechanism is held. Each of a pair of pedals affixed one each to each of the ends of the wheel and pedal mechanism is in turn attached to an elastic cord. Each of the two elastic cords is attached to a support block with one support block affixed atop the posterior side of one of the support units and with the other support block affixed to the posterior side of the other support unit. Each anterior side of each support unit has affixable within it, an elongated upright adjustable handle bar.

2. Objects of the Invention:

It is well known within the fields of biomechanics, physiatry and orthopedics that weak and/or sore and/or arthritic joints can operate to severely retard a person's ability to exercise leg muscles prone to disuse atrophy in the face of post-surgical rehabilitation or advancing age and concomitant lack of exercise. Such retardation of exercise capability is however greatly minimized when a person in need of such exercise is submerged to, for example, chest level in a pool of water.

The gentle resistance afforded by water can operate to facilitate one's ready pacing of oneself and in repetitively rhythmic fashion much moreso that can mere air so as to thereby enable one to appropriately exercise such muscles even in the face of such soreness or arthritis. Because of the soothing effects of water, the joints in such persons are rendered eminently more functional than would be the case without water. Also, bouyancy in water operates to cause less stress to muscles and joints during such exercising. Moreover, such persons in need of such an exercise option stand to gain as they otherwise would not from a cardiopulmonary vantage point as well. There is also the fact that intra-aquatic exercise is an excellent means for facilitating the rehabilitation of post-surgical patients. The instant invention readily addresses these needs for the above-described classes of persons, and, certain of its features such as, for example, bar and height adjustability enable it to be so utilized by a wide cross-section of such persons. Finally, by virtue of the character of its construction, the instant invention is very stable during use under water while at the same time providing in a much more ergonomic manner than do other similar devices amenable to use underwater, for cardiopulmonary benefit and large muscle maintenance or redevelopment in persons for whom such exercise underwater may perhaps be an only option.

For the reasons cited above, it is respectively submitted that the instant invention is indeed useful.

A DESCRIPTION OF THE DRAWINGS

FIG. 7 illustrates the adjustability of an upright handlebar component of the invention.

FIG. 8 illustrates positioning of an upright handlebar to portion of an anterior side of a support unit of the invention.

FIG. 9 is an isolated perspective view of an upright handlebar component in apposition to a support unit component.

FIG. 10 is a view of the upright handlebar component of FIG. 8 but turned through an angle of ninety degrees.

FIG. 11 is a top plan view of the handlebar component as seen in FIG. 8.

FIG. 12 is a top plan view of the handlebar component as seen in FIG. 9 absent an affixed ring unit.

A DESCRIPTION OF THE PREFERRED EMBODIMENT

Figure 1:
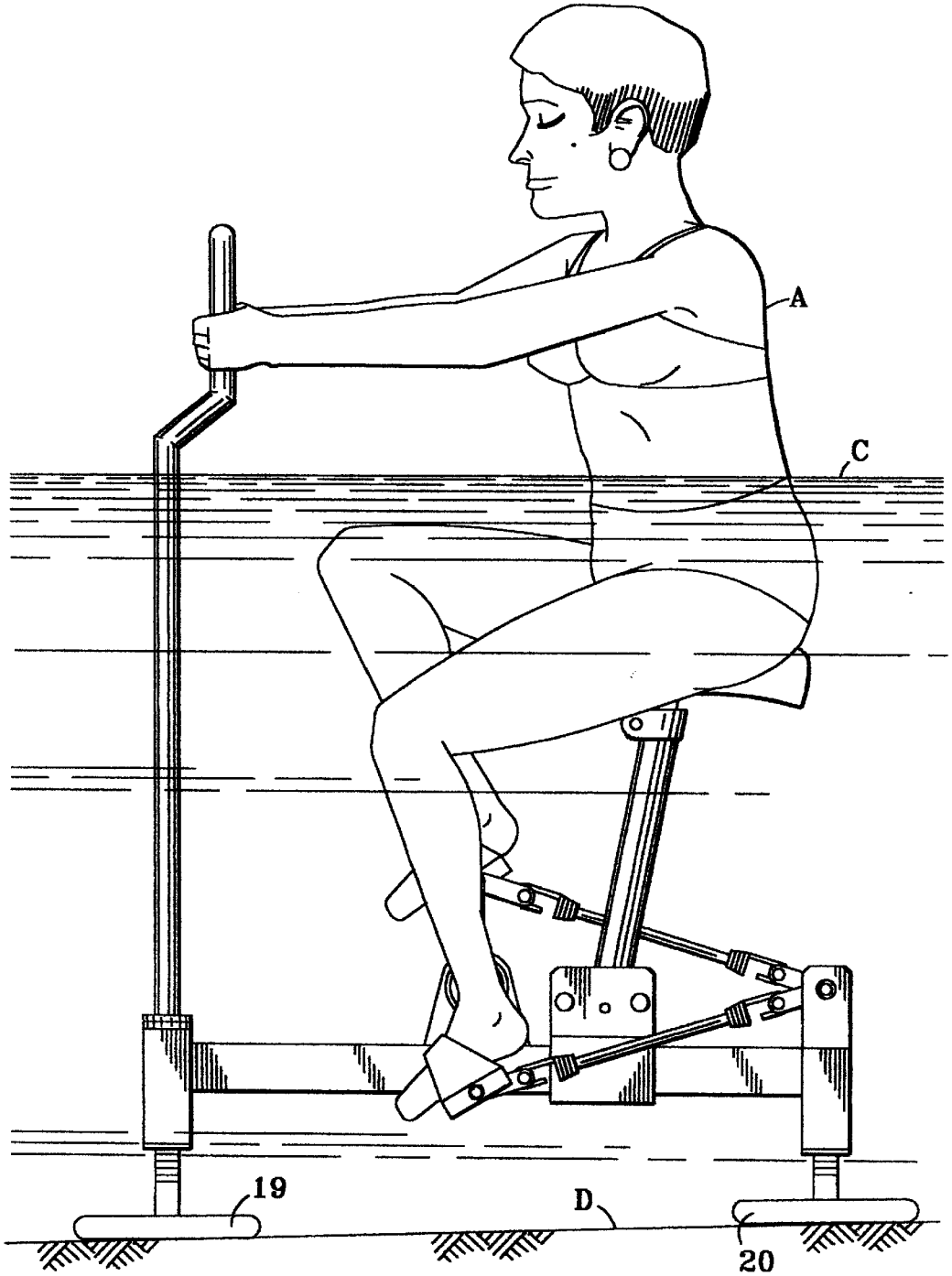
FIG. 1 is a perspective view of a person utilizing the invention underwater.
Figure 2:
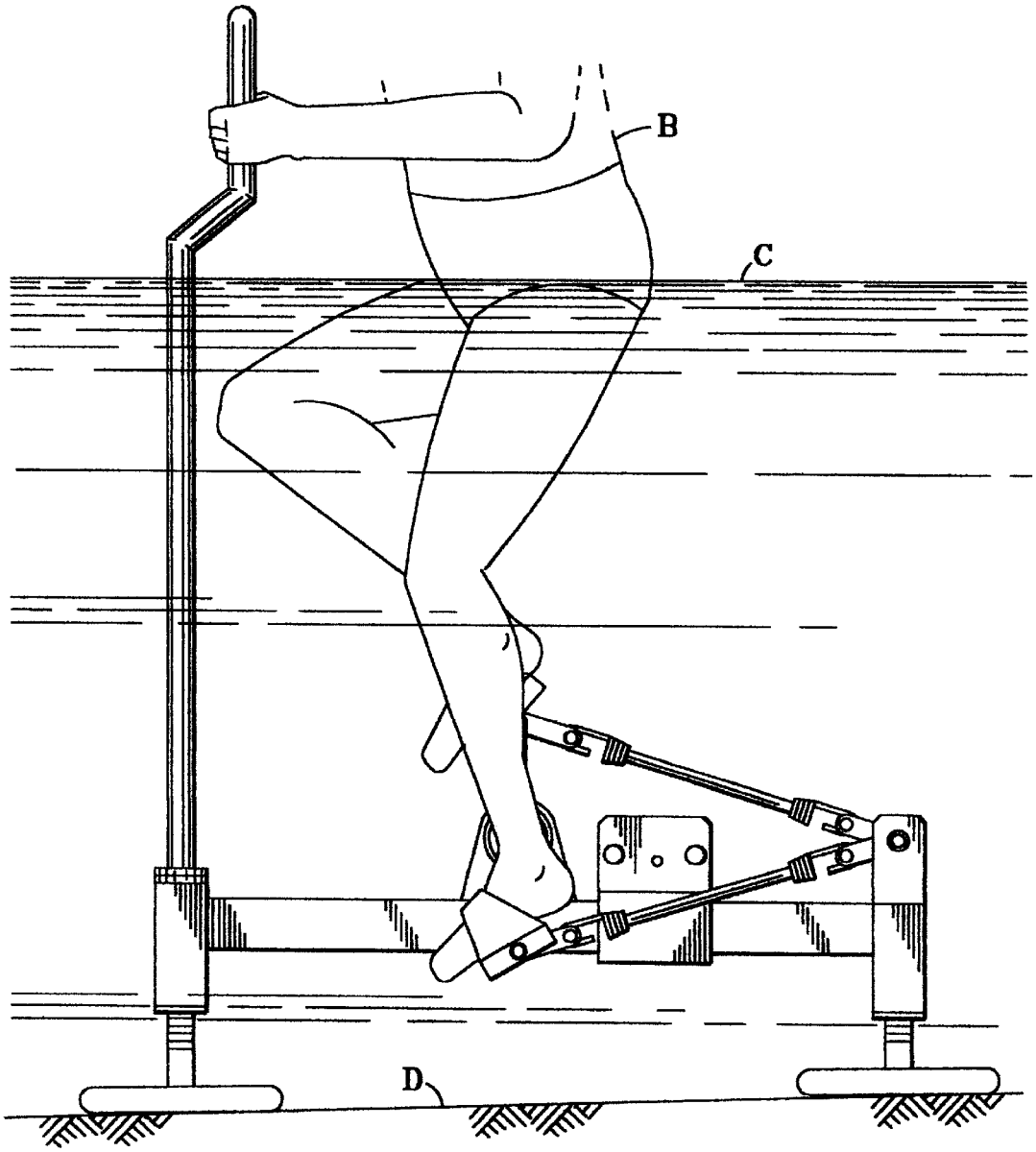
FIG. 2 is a perspective view of another person utilizing the invention underwater.
Figure 3:
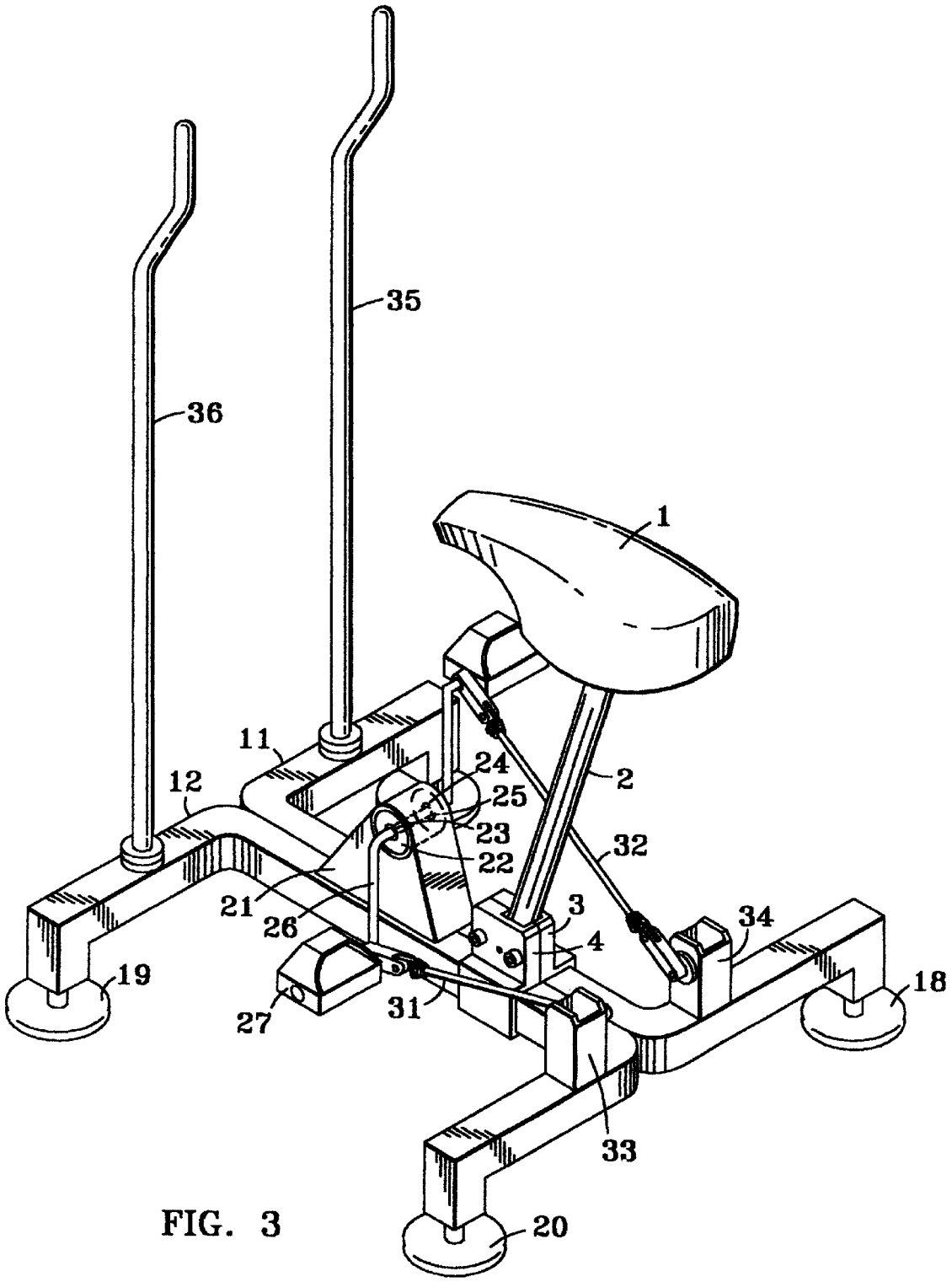
FIG. 3 is a perspective view of the invention.
Figure 19:
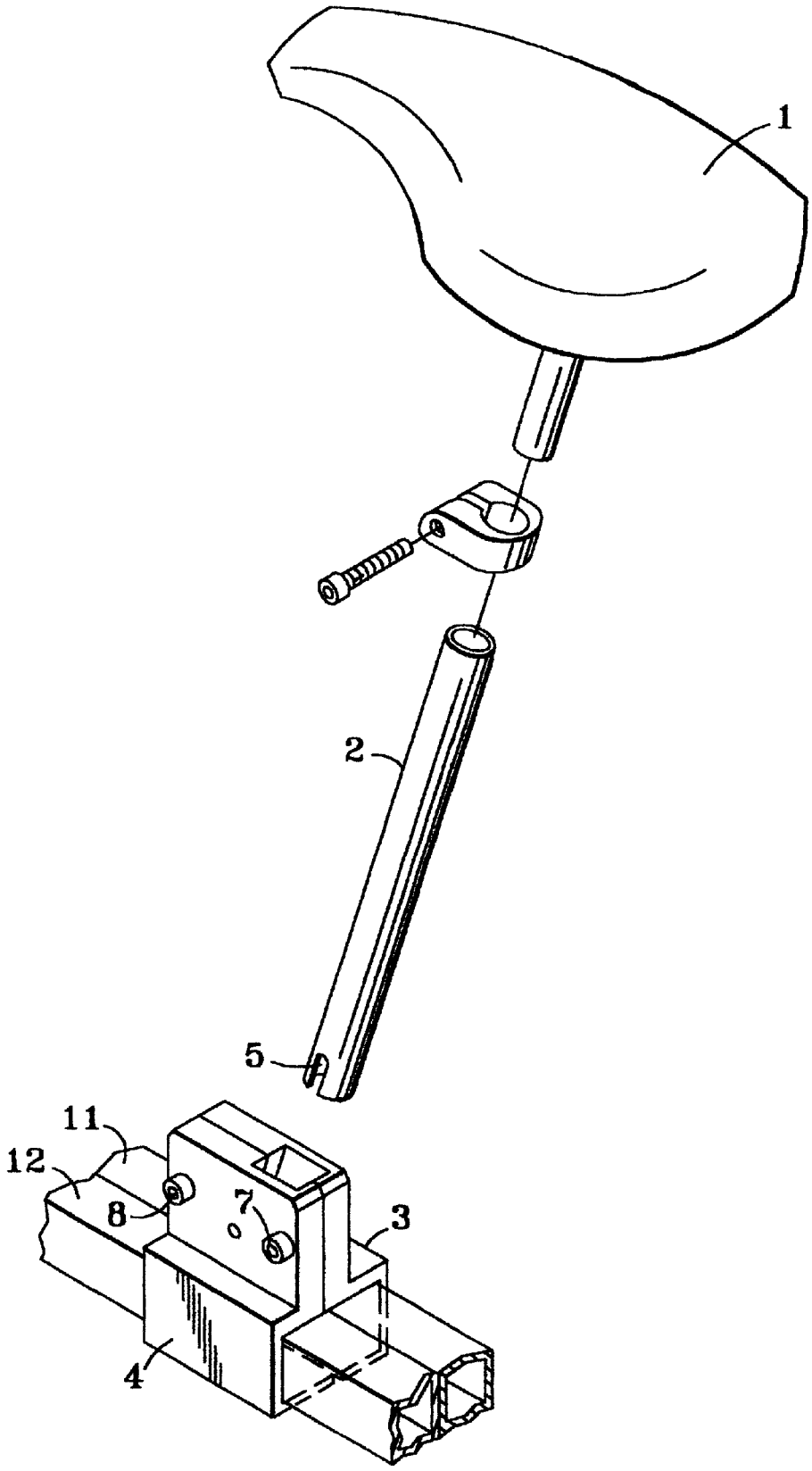
FIG. 19 is an isolated exploded view of the means of assembly in respect of the seat holding elongated support arm component and support unit components of the invention.
Figure 20:
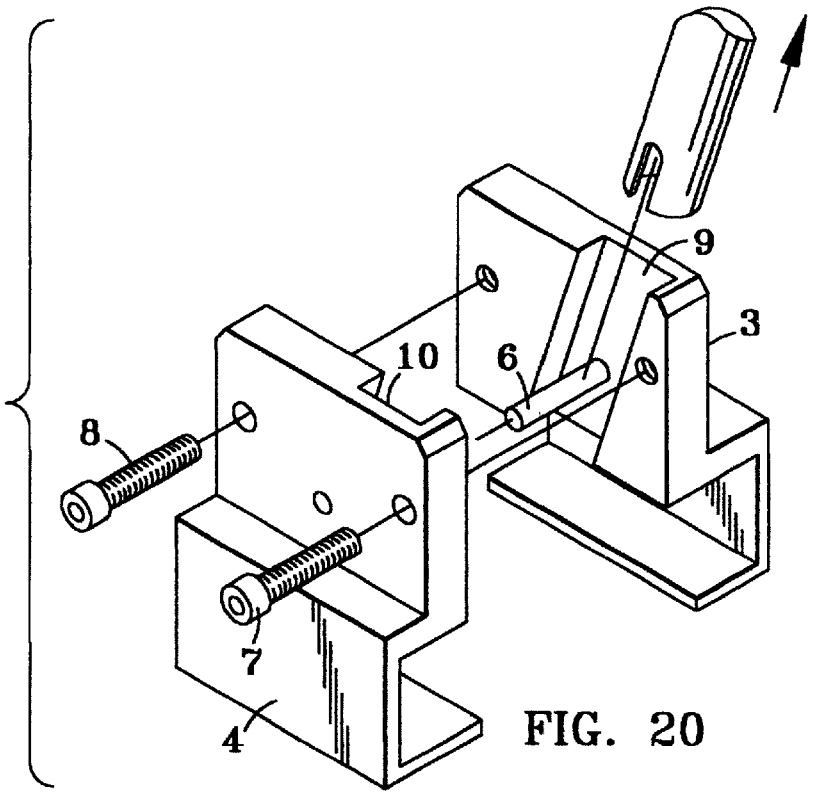
FIG. 20 is an isolated exploded perspective view of the pair of fastening vice components of the invention further serving to illustrate, in particular, the removable affixability of the seat holding elongated support arm.
Figure 21:
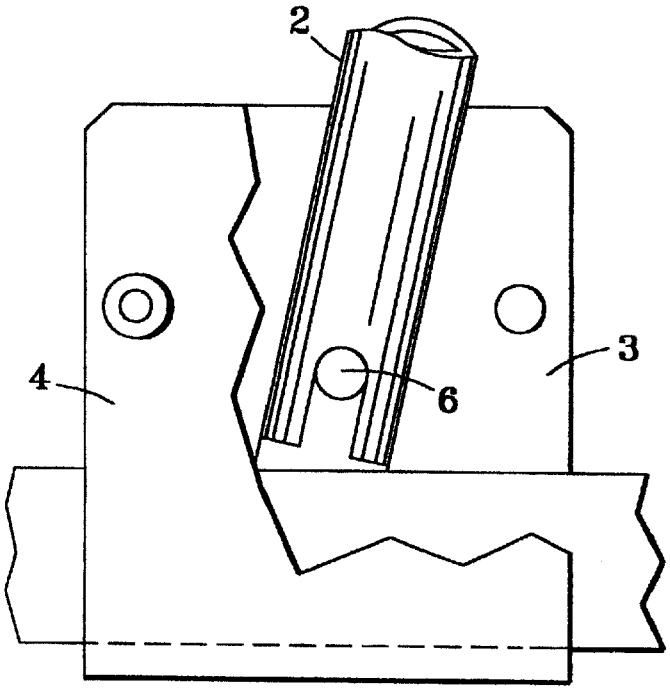
FIG. 21 is an isolated broken plan of the pair of fastening vice components further illustrating what is seen in FIG. 20.

FIG. 1 shows a person A utilizing the invention while seated in water C. FIG. 2 shows a person B utilizing the invention while standing in water C. FIG. 3 is a perspective view of the instant invention. A seating unit 1 is shown affixed to an elongated support arm 2. Arm 2 is removably held within reach of a pair of fastening vices 3 and 4 respectively shown in greater detail in FIGS. 19, 20 and 21. In FIG. 19, a manner of affixing seat 1 to arm 2 is disclosed. Moreover, a notch 5 in the bottom of and lowermost portion of arm 2 which said notch has a rounded uppermost portion is receivable about a cylindrical pin 6 seen in FIG. 20 which pin 6 is press fit into a closed hole found in medial walling of fastening vice 3. Pin 6 is receivable in turn by a hole in medial walling of fastening vice 4 with both holes having a common horizontal axis of symmetry. In this manner, arm 2 is removably affixable to and within vices 3 and 4 when vices 3 and 4 are screwed and bolted together by first screw-bolt assembly means 7 and second screw-bolt assembly means 8 as illustrated with resort to FIGS. 20 and 19 respectively. A first rectangularly shaped notch 9 cut at an angle into vice 3 and a second rectangularly shaped notch 10 cut an angle into vice 4 as seen in FIG. 20 facilitate receipt of arm 2 upon pin 6 when vices 3 and 4 are held fast to one another by way of assembly means 7 and 8.

Figure 4:
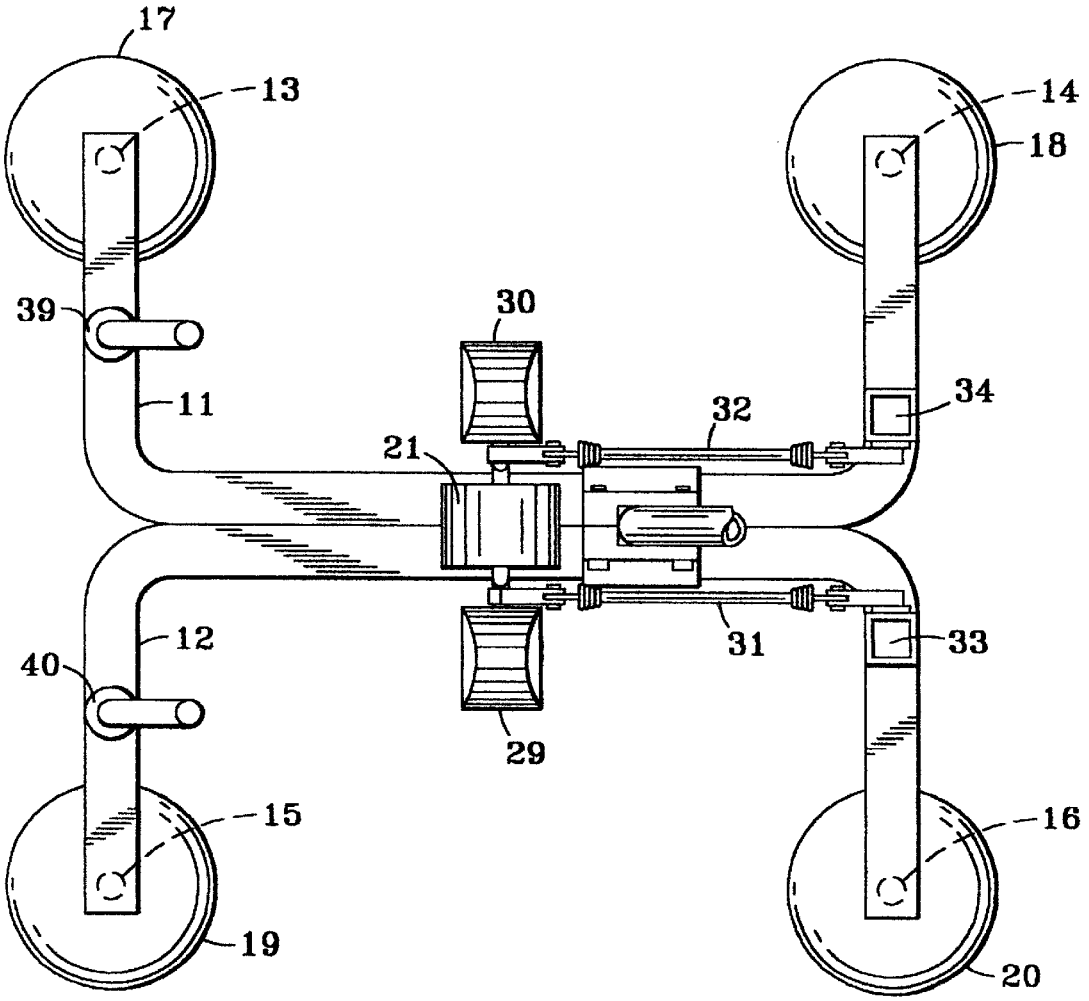
FIG. 4 is a top plan view of the invention.
Figure 5:
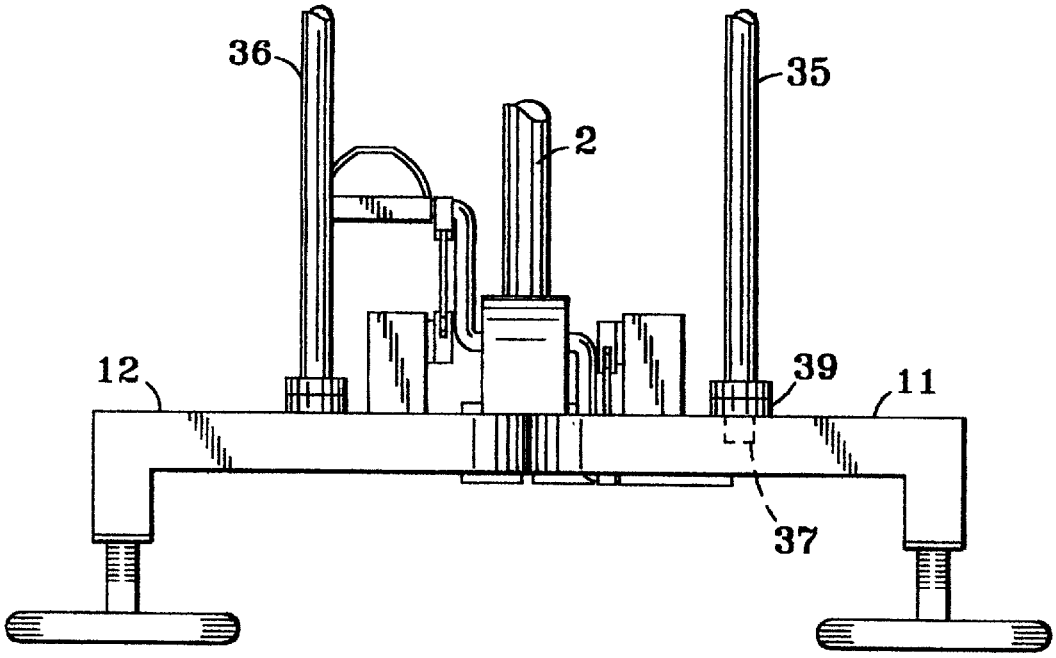
FIG. 5 is a rear plan view of a lower portion of the invention.
Figure 6:
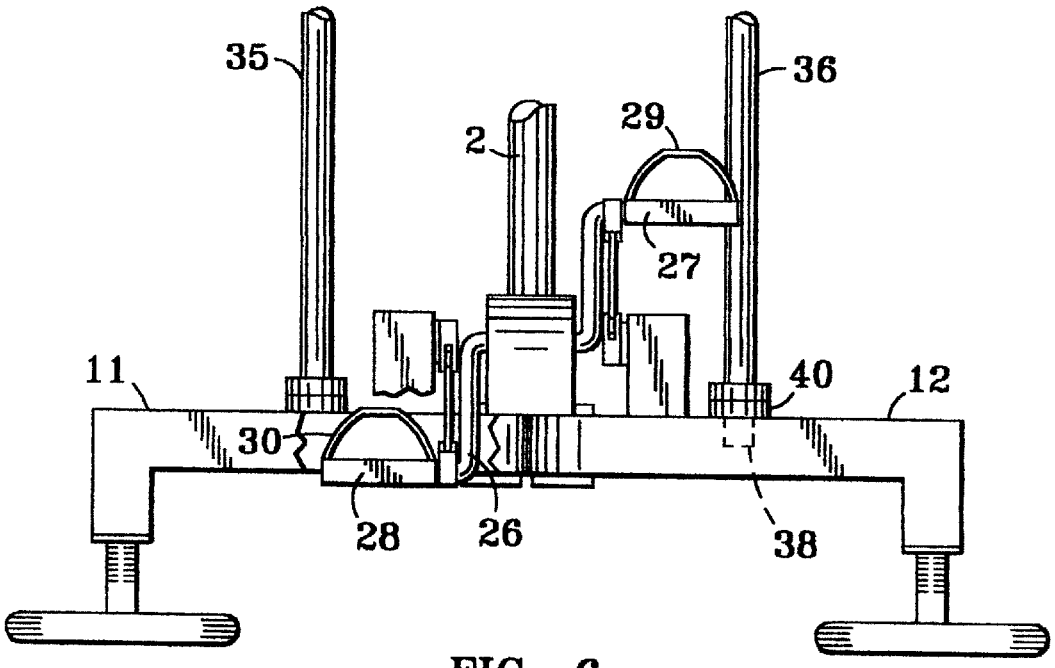
FIG. 6 is a front plan view of a lower portion of the invention.
Figure 13:
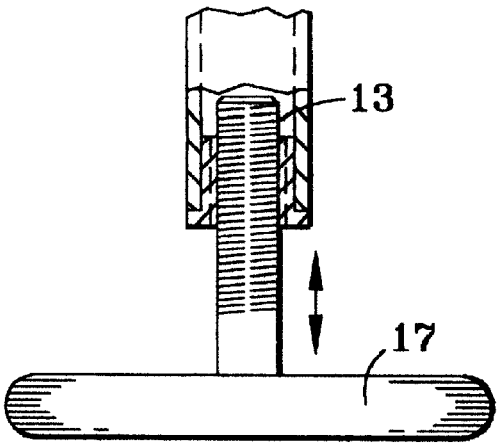
FIG. 13 is an isolated lateral plan view evidencing adjustability of one of the adjustable foot pod components of the invention.
Figure 14:
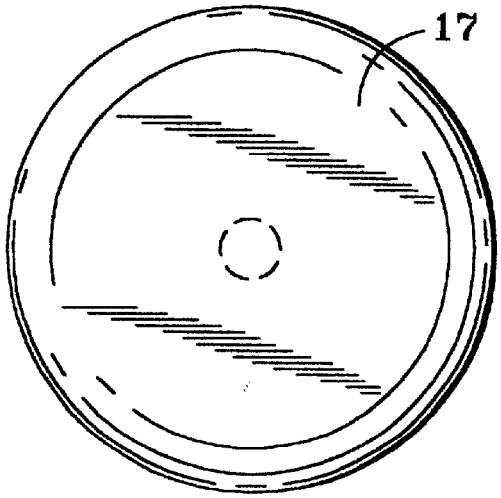
FIG. 14 is a bottom plan view of one of the adjustable foot pod components of the invention.
Figure 15:
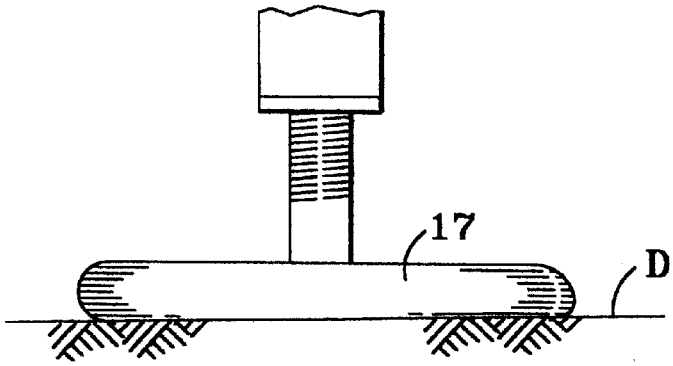
FIG. 15 is an isolated lateral plan view of one of the adjustable foot pod components resting upon the flooring of a pool amenable to holding water.
Figure 16:
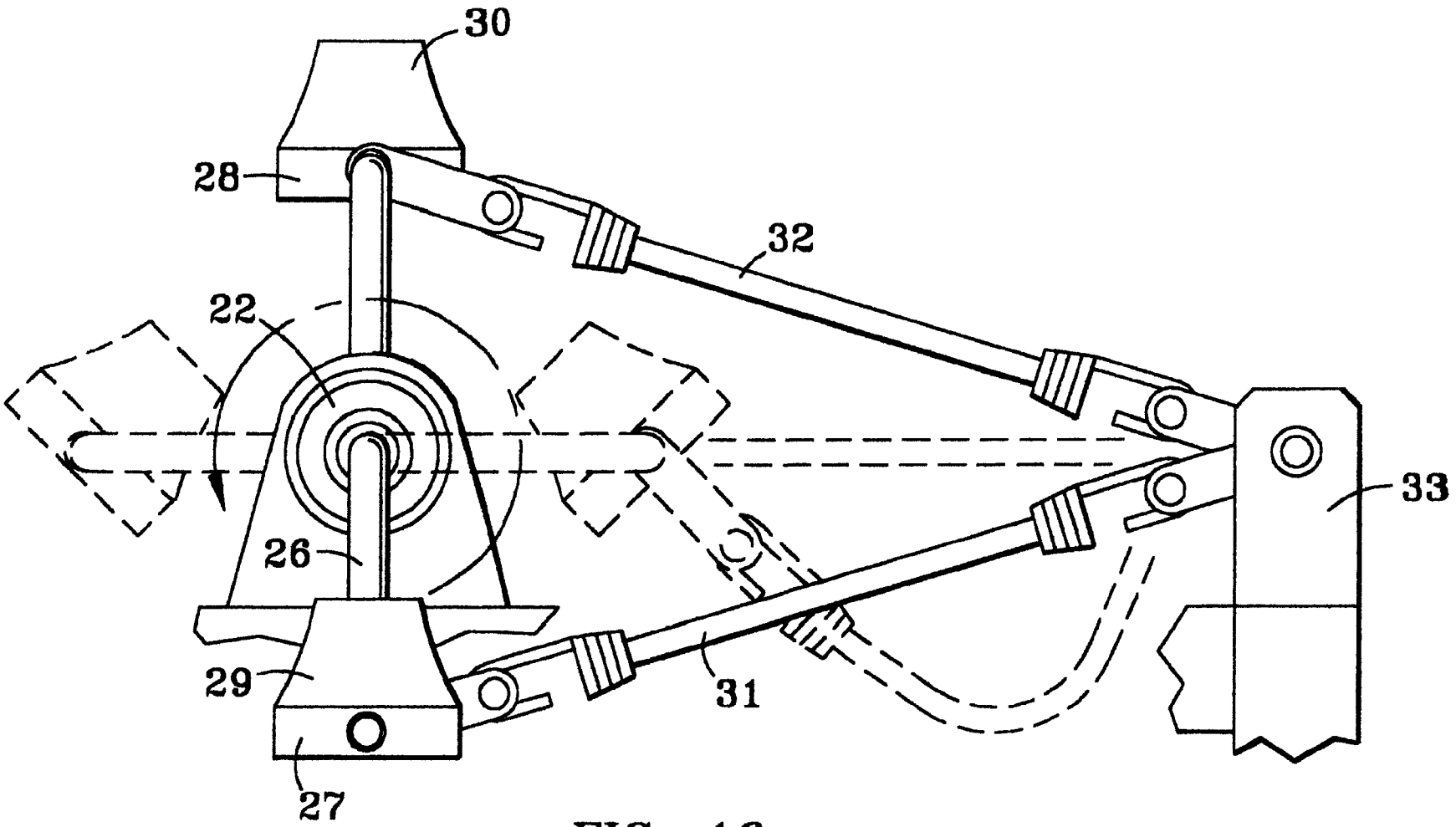
FIG. 16 is an isolated lateral plan view of the pedal-elastic cord system of invention.
Figure 17:
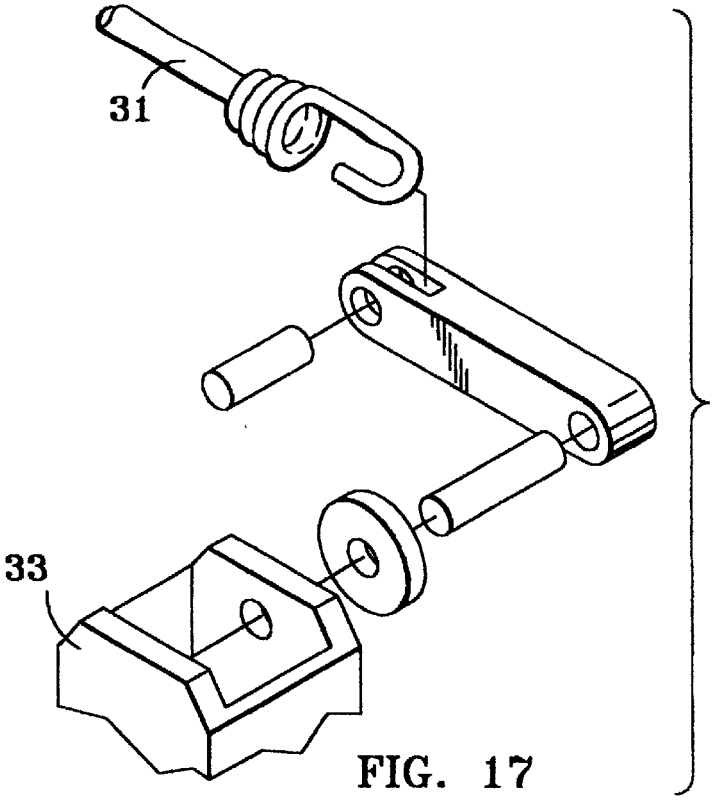
FIG. 17 is an isolated exploded view of a rear portion of one of the elastic cord components of the invention in apposition to a support block component thereof.
Figure 18:
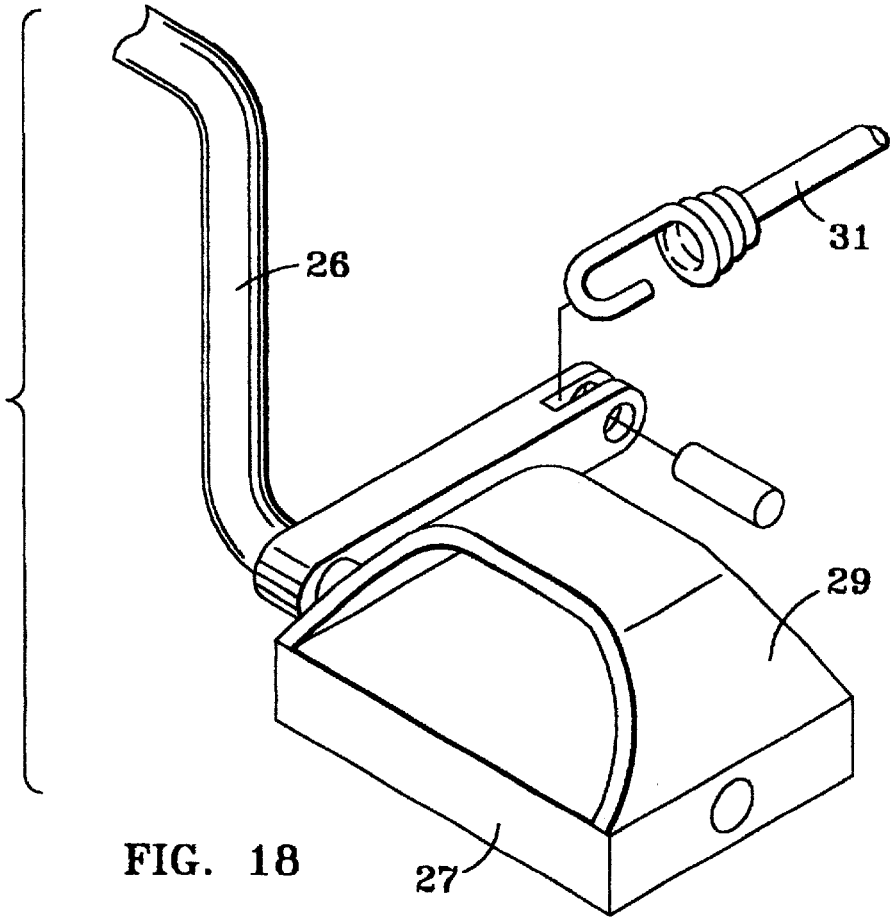
FIG. 18 is an isolated perspective view of a pedal component in apposition to an elastic cord component of the invention.

The instant invention is supported upon the flooring D of a swimming pool containing swimming pool water C by a first three-sided support unit 11 and a second three-sided support unit 12 as seen A first threadably aligned closed hole 13 in the bottom side of first three-sided support unit 11 is shown in FIG. 13. A first pod 17 is threadably, adjustably and removably insertable into threadably aligned closed hole 13 as is also seen in FIG. 13. A second threadably aligned closed hole 14 in the bottom face of a right lateral descending leg portion of the posterior side of unit 11 serves to receive second pod 18 which is a duplicate of pod 17 all as can be seen in FIG. 3 and likewise FIG. 4. Likewise a third such hole 15 is located in the bottom face of a left lateral descending leg portion of the anterior side of unit 12 which hole 15 similarly receives a pod 19. A fourth such hole 16 in the bottom face of a left lateral descending leg portion of the posterior side of unit 12 similarly serves to receive a pod 20. A viewing of FIG. 14, a bottom view of one of the four duplicate pods, to wit, pod 17 of the invention in conjunction with FIG. 15 serves to demonstrate how the pods can readily rest on pool flooring D as seen in FIG. 1. Adjustability of the pods by turning them clockwise up or counterclockwise down as shown in FIG. 13 enables one to adjust the height of the invention above the level of pool flooring D as the remainder of the invention is likewise supported thereupon by such pod components. Screw-bolt assembly means 7 and 8 serve to hold middle sides of units 11 and 12 fast together as seen in FIGS. 3 and 4 by way of holding first fastening vice means 3 fast to second fastening vice means 4. A housing unit 21 is affixed to the top of the middle sides of units 11 and 12 respectively as can be seen in FIG. 3. Housing unit 21 is characterized by the presence of a first wheel 22 revolvably inserted into a first hole within a left lateral side of housing unit 21. Wheel 22 has a first central hole 23 within it. Housing unit 21 also has a second wheel 24 with a horizontal axis of symmetry coincident with that of first wheel 22 which wheel 24 is revolvably inserted into a second hole within a right lateral side of unit 21. A second central hole 25 is located within wheel 24. A stepwise shaped pedal arm 26 is insertable through hole 23 and hole 25. A first pedal unit 27 is affixed to one end of pedal arm 26, and a second pedal unit 28 is attached to the other end of pedal arm 26. A first foot hood 29 is affixed to a medial side and a lateral side of pedal unit 27, and a second foot hood 30 is affixed to a medial side and a lateral side of pedal unit 28. All of the foregoing elements are seen with resort to FIG. 3. A first elastic cord 31 is affixed at a first end to the medial side of pedal unit 27 and a second elastic cord 32 is affixed at a first end thereof to the medial side of pedal unit 28 as also seen in FIG. 3. FIG. 18 serves to illustrate close up the manner of assembly of one of the pedal units of the instant invention and, the manner of its attachment to one of the elastic cord components of the instant invention. A first support block 33 is affixed to the posterior side of support unit 12 and a second support block 34 is affixed to the posterior side of support unit 11. Cord 31 is affixed at a second end to block 33 as seen in FIG. 17 and cord 32 is similarly affixed at a second end to block 34. A first upright handlebar 35 and a second upright handlebar 36 are seen affixed respectively to support units 11 and 12 once again with reference to FIG. 3. The manner of attachment of handlebars 35 and 36 to units 11 and 12 is to be noted with reference to FIGS. 7, 8, 9, 10, 11 and 12 respectively. To begin with, the anterior sides of support units 11 and 12 are characterized by the presence of closed holes 37 and 38 respectively as can be noted with reference to FIGS. 5 and 6 respectively. A cylindrically shaped washer unit 39 within which there is a concentric hole with a vertical axis of symmetry coincident with that of closed hole 37 and a cylindrically shaped washer unit 40 within which there is also a concentric hole with a vertical axis of symmetry coincident with that of closed hole 38 are located respectively affixed atop anterior sides of support units 11 and 12 as can be noted with reference once again to FIGS. 5 and 6. A plurality of vertically inclined small closed holes 39A are located within unit 39 circumscribing the concentric hole thereof as is shown in FIG. 7. A first ring unit 41 is affixed about a lower portion of handlebar 35 as seen in FIG. 7 and a second ring unit 42 is shown in FIG. 9 affixed about a lower portion of handlebar 36. A through hole 43 in ring unit 41 is seen in FIG. 8 and an equivalent through hole 44 in ring unit 42 is to be noted with reference to FIG. 10. A ring pin 45 fits through hole 42 as seen in FIG. 7. A ring pin 46 fits through hole 44 as seen in FIG. 10. Handlebar 35 is insertable into closed hole 37 through the concentric hole in washer unit 40. Ring pin 45 is insertable into any one of holes 39A as handlebar 35 is inserted into hole 37 through the concentric hole in washer unit 39 and ring pin 46 is insertable into any one of holes 40A as handlebar 36 is insertable into closed hole 38 through the concentric hole in washer unit 40. A person A can occupy the instant invention positioned on flooring D of a pool of water C by sitting on seat 1 and holding on to handlebars 35 and 36 as seen in FIG. 1 and then pedal thereupon with the actions as depicted in FIG. 16. FIGS. 7, 10, 11 and 12 serve to illustrate how handlebars 35 and 36 can be adjusted to fit the various needs of different pedaling individuals by simply causing ring pins 45 and 46 to be positioned into whichever holes 39A and 40A one wishes. If, on the other hand, a person B as seen in FIG. 2 wishes to pedal within water, standing up instead of sitting down, then all that need be done is to first remove support arm 2 from within fastening vices 3 and 4 by simply pulling it out, as per, for example, the manner of removal illustrated perforce of the arrow shown in FIG. 20 before commencing to pedal and exercise while in a standing position.

In conclusion, it is respectfully, submitted that the instant invention is not only new and unique nor only useful for the reasons earlier cited but is rather indeed virtually revolutionary in respect of the art of devices suitable for exercising on the part of post-surgical patients or patients in need of muscle and/or joint rehabilitation.

What is claimed is:

1. An underwater exercise apparatus, comprising:

a. a seating unit;

b. an elongated support arm to which said seating unit is removably attached;

c. a first three-sided support unit;

d. a second three-sided support unit;

e. a first threadably aligned closed hole in a bottom face of a lateral descending leg portion of an anterior side of said first three-sided support unit;

f. a second threadably aligned closed hole in a bottom face of a lateral descending leg portion of a posterior side of said first three-sided support unit;

g. a third threadably aligned closed hole in a bottom face of a lateral descending leg portion of an anterior side of said second three-sided support unit;

h. a fourth threadably aligned closed hole in a bottom face of a lateral descending leg portion of a posterior side of said second three-sided support unit;

i. a first pod threadably, adjustably and removably insertable into said first threadably aligned closed hole;

j. a second pod threadably, adjustably and removably insertable into said second threadably aligned closed hole;

k. a third pod threadably, adjustably and removably insertable into said third threadably aligned closed hole;

l. a fourth pod threadably, adjustably and removably insertable into said fourth threadably aligned closed hole;

m. first fastening vice means for holding a middle side of said first three-sided support unit fast to a middle side of said second three-sided support unit;

n. second fastening vice means for holding said middle side of said first three-sided support unit fast to said middle side of said second three-sided support unit;

o. a cylindrical pin press fitted into a closed hole in a medial wall of said first fastening vice means;

p. a hole in a medial wall of said second fastening vice means for receipt of said cylindrical pin;

q. a first rectangularly shaped notch cut at an angle into said first fastening vice means;

r. a second rectangularly shaped notch cut at an angle into said second fastening vice means;

s. an elongated notch rounded at an upper end thereof cut into a bottom side and lowermost portion of said elongated support arm for removable receipt of said elongated support arm by said cylindrical pin within the confines of said first and said second rectangularly shaped notches;

t. a first screwbolt assembly means for holding said first fastening vice means fast to said second fastening vice means through a first pair of concentric through holes, one of which is located within said first fastening vice means and the other being within said second fastening vice means;

u. a second screw bolt assembly means for holding said first fastening vice means fast to said second fastening vice means through a second pair of concentric through holes, one of which is located within said first fastening vice means and the other being within said second fastening vice means;

v. a housing unit affixed to a top portion of said middle side of said first three-sided support unit and to a top portion of said middle side of said second three-sided support unit;

w. a first wheel revolvably inserted into a first hole within a first lateral side of said housing unit;

x. a first central hole within said first wheel;

y. a second wheel revolvably inserted into a second hole within a second lateral side of said housing unit;

z. a second central hole within said second wheel;

aa. a stepwise shaped pedal arm insertable through said first central hole and said second central hole;

bb. a first pedal unit affixed to a first end of said pedal arm;

cc. a second pedal unit affixed to a second end of said pedal arm;

dd. a first foot hood affixed to a medial side and a lateral side of said first pedal unit;

ee. a second foot hood affixed to a medial side and a lateral side of said second pedal unit;

ff. a first elastic cord removably affixed at a first end thereof to said pedal arm adjacent said medial side of said first pedal unit;

gg. a second elastic cord removably affixed at a first end thereof to said pedal arm adjacent said medial side of said second pedal unit;

hh. a first support block affixed atop a posterior side of said second three-sided support unit;

ii. a second support block affixed a posterior side of said first three-sided support unit;

jj. said first elastic cord being removably affixed at a second end thereof to said first support block;

kk. said second elastic cord being removably affixed at a second end thereof to said second support block;

ll. a first upright elongated handlebar;

mm. a second upright elongated handlebar;

nn. a first anterior side closed hole in a top portion of an anterior side of said first three-sided support unit;

oo. a second anterior side closed hole in a top portion of an anterior side of said second three-sided support unit;

pp. a first cylindrically shaped washer unit within which there is a first concentric hole affixed to said top portion of said anterior side of said three-sided support unit;

qq. a second cylindrically shaped washer unit within which there is a second concentric hole affixed to said top portion of said anterior side of said second three-sided support unit;

rr. said first anterior side closed hole and said first concentric hole having a common vertically inclined first central axis of symmetry;

ss. said second anterior side closed hole and said second concentric hole having a common vertically inclined second central axis of symmetry;

tt. a plurality of first small closed holes vertically inclined within said first cylindrically shaped washer unit all circumscribing said first concentric hole;

uu. a plurality of second small closed holes vertically inclined within said second cylindrically shaped washer unit all circumscribing said second concentric hole;

vv. a first ring unit affixed to a lower portion of said first upright elongated handlebar;

ww. a first ring through hole in said first ring unit;

xx. a second ring affixed to a lower portion of said second upright elongated handlebar;

yy. a second ring through hole in said second ring unit;

zz. a vertically positioned first ring pin affixed within said first ring through hole;

aaa. a vertically positioned second ring pin affixed within said second ring through hole;

bbb. said first upright elongated handlebar being revolvably insertable into said first concentric hole and said first anterior side closed hole;

ccc. said second upright elongated handlebar being revolvably insertable into said second concentric hole and said second anterior side closed hole;

ddd. said first ring pin being removably insertable into one of said plurality of first small closed holes coincident with an insertion of said first upright elongated handlebar into said first concentric hole and said first anterior side closed hole, and;

eee. said second ring pin being removably insertable into a corresponding one of said pluarlity of second closed holes coincident with an insertion of said second upright elongated handlebar into said second concentric hole and said second anterior side closed hole.

* * * * *